United States Patent [19]

Lowrey et al.

[11] 4,379,835

[45] Apr. 12, 1983

[54] BLACK IMAGE FROM A THERMOGRAPHIC IMAGING SYSTEM

[75] Inventors: Robert D. Lowrey, Saint Paul, Minn.; Howard D. Nelson, River Falls, Wis.; George Van Dyke Tiers, all of Saint Paul, Minn.

[73] Assignee: Minnesota Mining and Manufacturing Company, Saint Paul, Minn.

[21] Appl. No.: 218,559

[22] Filed: Dec. 22, 1980

[51] Int. Cl.[3] ..... G03C 1/72; B41M 5/18; B41M 5/26

[52] U.S. Cl. ..... 430/338; 430/332; 430/336; 430/337; 430/340; 430/341; 430/342; 430/343; 430/351; 430/346; 430/495; 428/913; 428/411; 428/481; 428/537; 250/317.1; 106/14.5

[58] Field of Search ..... 430/351, 340, 341, 342, 430/343, 332, 337, 495, 338, 336, 346; 428/913, 411, 481, 488, 537; 250/317.1; 106/14.5

[56] References Cited

U.S. PATENT DOCUMENTS

| | | | |
|---|---|---|---|
| 2,910,377 | 10/1959 | Owen | 117/36 |
| 3,031,329 | 4/1962 | Wingert | 117/36.8 |
| 3,080,254 | 3/1963 | Grant, Jr. | 117/36.8 |
| 3,102,810 | 9/1963 | Sprague et al. | 430/281 |
| 3,460,964 | 8/1969 | Dunham | 428/411 |
| 3,682,684 | 8/1972 | Newman et al. | 117/36.9 |
| 3,974,147 | 8/1976 | Tiers et al. | 260/240 D |
| 3,986,880 | 10/1976 | Wainer et al. | 430/340 |
| 4,066,459 | 1/1978 | Bachman et al. | 430/337 |

FOREIGN PATENT DOCUMENTS

| | | |
|---|---|---|
| 51-941 | 1/1976 | Japan . |
| 51-27544 | 8/1976 | Japan . |
| 51-43786 | 11/1976 | Japan . |
| 52-23806 | 7/1977 | Japan . |
| 52-25330 | 7/1977 | Japan . |

OTHER PUBLICATIONS

Kosar, J., "Light-Sensitive Systems", Wiley & Sons, 1965, pp. 406, 302, 303, 366-369.

L. F. A. Mason, "Photographic Processing Chemistry," The Focal Press, London, pp. 219-220, 1966.

Mees and James, "The Theory of the Photographic Process," 3rd ed., 283-284, and 390-391.

Kosar, "Light Sensitive Systems," pp. 367 and 370-380.

"Colorimetry: Official Recommendations of the International Commission on Illumination," Publication CIE No. 15 (E-1.3.1.) 1971.

"CIE Recommendations on Uniform Color Spaces, Color-Difference Equations, and Metric Color Terms," May 1976, Supplement No. 2 to CIE Publication No. 15 Colorimetry (E-1.3.1.) 1971.

"Munsel Book of Color," Neighboring Hues Edition, Matte Finish Collection, 1973.

*Primary Examiner*—Charles L. Bowers, Jr.

*Attorney, Agent, or Firm*—Cruzan Alexander; Donald M. Sell; Jennie G. Boeder

[57] ABSTRACT

A thermographic imaging system comprising a single layer and capable of providing a stable dark to black image upon localized heating is disclosed. The single layer comprises a polymeric binder, a combination of at least two leuco dyes, and a nitrate salt.

19 Claims, No Drawings

BLACK IMAGE FROM A THERMOGRAPHIC IMAGING SYSTEM

FIELD OF THE INVENTION

A single layer comprising a nitrate salt and at least two leuco dyes in a binder is useful as an imaging layer. The layer is imaged by heating in an imagewise fashion to oxidize the leuco dyes to a dark or darkish to black image.

BACKGROUND OF THE INVENTION

Black images on clear film have been made by using silver soaps in a film formula. Such systems are disclosed in U.S. Pat. Nos. 2,910,377; 3,031,329; 3,080,254; and 3,682,684. In the photographic area, black images have been made by combining dyes in multiple dye layers. Disclosures concerning these systems include L. F. A. Mason, Photographic Processing Chemistry, The Focal Press, London, 1966, pages 219 and 220; and commonly assigned copending U.S. Ser. No. 199,444, filed Oct. 22, 1980.

SUMMARY OF THE INVENTION

The present invention provides a low cost replacement for the silver soaps normally utilized to provide black imaging systems. The present invention provides a combination of materials which may be applied to a film in a single coating and which provides a stable dark or blackish to black image when subjected to thermographic imaging means. It is surprising to note that the leuco dyes act as one to produce a stable neutral dark image at a wide range of temperatures, i.e., about 80° to 160° C., and regardless of the sensitivities of the individual leuco dyes.

The present invention may be practiced in any polymeric binder system having the necessary active ingredients therein. These ingredients comprise a mixture of at least two leuco dyes and a nitrate salt preferably supplied as a hydrated nitrate salt. The active ingredients may also include any material which supplies hydrogen ion, such as an acidic material. A binder material containing these ingredients can be colorized locally by heating portions of the binder layer or generally colorized by heating the entire layer. The presence of an acidic material accelerates the colorization phenomenon.

DETAILED DESCRIPTION OF THE INVENTION

There are a minimum of four components to the present invention, and at least five components to the preferred construction of the present invention. The four required components are two different leuco dyes, the nitrate salt, and the polymeric binder. For the preferred construction there is present at least one additional leuco dye.

THE BINDER

Almost any polymeric binder may be used in the practice of the present invention. The resin may be weakly basic, neutral or acidic. The acidity of the resin has been found to affect only the speed of the colorizing effect. Organic polymeric resins, preferably thermoplastic although thermoset resins may be used, are generally preferred. Where speed is more important, either the more acidic resins should be used or an acid should be added to the system to increase the rate of colorizing.

Such resins as polyvinyl acetals, polyester, polyvinyl resins, polyvinylpyrrolidone, polyesters, polycarbonates, polyamides, polyacrylates, cellulose esters, copolymers and blends of these classes of resins, and others have been used with particular success. Natural polymeric materials such as gelatin and gum arabic may also be used. Where the proportions and activities of dyes and nitrate salt require a particular developing time and temperature, the resin should be able to withstand those conditions. Generally it is preferred that the polymer not decompose or lose its structural integrity at 93° C. for 30 seconds, and most preferred that it not decompose or lose its structural integrity at 127° C. for 30 seconds.

Beyond these minimal requirements, there is no criticality in the selection of a binder. In fact, even transparency and translucency are not required, although they are desirable. Where, for example, the polymer is itself an opaque white, the thermally treated area will become a neutral dark color and the non-treated areas will remain white.

The binder normally maintains the other components of the coating in solution. Additionally, the binder may serve a number of other important purposes in the constructions of the present invention, i.e., it may protect the imageable materials from environmental conditions, such as moisture.

THE NITRATE SALT

Nitrate salts are themselves well known. They may be supplied as various chemical compounds, but are desirably provided as metal salts, and most preferably as hydrated metal salts. Other ions which are ordinarily good oxidizing ions such as nitrite, chlorate, iodate, perchlorate, periodate, and persulfate do not provide comparable results. Extremely active oxidizing agents, such as iodate, even used in relatively smaller proportions to prevent complete and immediate oxidation or colorization of dyes do not perform nearly as well as nitrate ion compositions. The performance of nitrate is so far superior to any other ion that it is apparently unique in the practice of the present invention. While some of the better oxidizing ions other than nitrate produce a maximum density ($D_{max}$) in the image of about 0.90 and a minimum density ($D_{min}$) of 0.25 in their best construction, the better constructions with nitrate ions can have a $D_{max}$ in excess of 1.0 and a $D_{min}$ below 0.10.

Most means of supplying the nitrate salt into the composition are satisfactory, e.g., organic salts, metal salts, acidic salts, mixtures of acids and salts, and other means of supplying the ion are useful. For example, nitrates of zinc, cadmium, calcium, zirconyl ($Z_rO^{+2}$), nickel, aluminum, chromium, iron(III), copper(II), magnesium, lead, cobalt, beryllium, cerous, lanthanum, manganous, mercurous, uranyl, and thorium, ammonium nitrate, and cerous ammonium nitrate have been used.

The nitrate salt component of the present invention must be present in a form within the imaging layer so that oxidizing quantities of $HNO_3$, or oxides of nitrogen, e.g., $NO_2$, or $N_2O_4$, will be provided within the layer when it is heated to a temperature no greater than 200° C. for 60 seconds and preferably at much lower temperatures and shorter times. This may be accomplished with many different types of salts, both organic and inorganic, and in variously different types of constructions.

The most convenient way of providing such nitrate salts is to provide a hydrated nitrate salt such as aluminum nitrate nonahydrate ($Al(NO_3)_3.9H_2O$). This salt, when heated in a binder, will generate $HNO_3$ and/or oxides of nitrogen in various amounts. The binder should not be so alkaline that the liberated nitric acid would be immediately neutralized, as this would adversely affect the oxidizing capability of the system. It is not essential that a completely acidic or neutral environment be provided, but even a mildly alkaline environment may in many cases completely prevent oxidation. It is therefore desired that the nitrate salt be neutral, and more preferably acidic.

In addition to hydrated nitrate salts, nonhydrated salts in layers which are neutral and preferably in an acidic environment are also capable of providing $HNO_3$ and/or oxides of nitrogen in sufficient quantities to provide the oxidizing capability necessary for practice of the present invention. Ammonium nitrate, for example, does not enable good oxidation in the present invention in a layer which is even mildly alkaline, but when a moderate strength organic acid such as phthalic acid is added, a quite acceptable imaging system is provided.

Beside the inorganic types of salts generally described above, organic salts in nonalkaline environments are also quite useful in the practice of the present invention. In particular, ammonium salts such as guanidinium nitrate work quite well in acid environments, but will not provide any useful image in alkaline environments.

It is believed that the alkaline environment causes any oxidizing agent (e.g., $HNO_3$ and oxides of nitrogen) which is liberated from the nitrate salt to be preferentially reacted with hydroxy ions or other neutralizing moieties so as to prevent oxidation of the dyes. For this reason it is preferred to have the environment of the nitrate salt be neutral and more preferably, slightly acidic.

One other consideration should be given in the selection of the nitrate salt and that is the choice of a salt in which the cation is nonreactive with the dye. Nonreactive salts are defined in the practice of the present invention as those salts the cations of which do not spontaneously oxidize the dyes that they are associated with at room temperature. This may be readily determined in a number of fashions. For example, the dye and a nonnitrate (preferably halide) salt of the cation may be codissolved in a solution. If the salt oxidizes the dye spontaneously (within two minutes) at room temperature, it is a reactive salt. Such salts as silver trifluoromethyl sulfonate, in which the cation is itself a strong oxidizing agent, is a reactive salt. Ceric trifluoromethyl sulfonate is also reactive, while hydrated cerous trifluoromethyl sulfonate is not.

Preferred salts are the hydrated metal salts such as nickel nitrate hexahydrate, magnesium nitrate hexahydrate, aluminum nitrate nonahydrate, ferric nitrate nonahydrate, cupric nitrate trihydrate, zinc nitrate hexahydrate, cadmium nitrate tetrahydrate, bismuth nitrate pentahydrate, thorium nitrate tetrahydrate, cobalt nitrate hexahydrate, gadolinium or lanthanum nitrate nonahydrate, mixtures of these hydrated nitrates and the like. Nonhydrated or organic nitrates may be admixed therewith.

Organic nitrates are also quite useful in the practice of the present invention. These nitrates are usually in the form of guanadinium nitrate, pyridinium nitrate, and the like. Nitrate salts of dyes will also be useful, but again, they must be used in an environment which will not neutralize any liberated $HNO_3$ and/or oxides of nitrogen.

It is preferred to have at least 0.10 moles of nitrate ion per mole of dye. It is more preferred to have at least 1.0 mole of ion per mole of dye, and it is most preferred to have 2–3 moles of ion per mole of dye. However, even amounts up to 100 moles of nitrate ion per mole of dye have been found useful. Since certain dyes are subject to destruction by the decomposition products produced by the oxidation of the nitrate ion, it is necessary to adjust the nitrate ion ratio so as not to be excessive enough to cause substantial destruction.

LEUCO DYES

Leuco dyes are colorless compounds which when subjected to an oxidation reaction form a colored dye. These leuco dyes are well known in the art (e.g., *The Theory of the Photographic Process,* 3rd Ed., Mees and James, pp. 283–4, 390–1, Macmillan Co., N.Y.; and *Light-Sensitive Systems,* Kosar, pp. 367, 370–380, 406 (1965) Wiley and Sons, Inc., N.Y.). Only those leuco dyes which can be converted to colored dyes by oxidation are useful in the practice of the present invention. Acid or base sensitive dyes such as phenolphthalein are not useful in the present invention unless they are also oxidizable to a colored state. Indicator dyes would only form transient images or would be too sensitive to changes in the environment.

A minimum of two leuco dyes must be present in the imaging composition of the present invention, with the presence of three leuco dyes being preferred. The useful leuco dyes are those which are oxidized by nitrate ion, and when combined together and thermally developed provide a dark or blackish to black image having strong absorbence throughout the range between about 450 and 650 nms. The terms "dark", "blackish", and "black" are defined as follows. With respect to light reflecting images the image is viewed against a white surround (typically as textual material on white paper); colors and darkness can be conveniently described by comparison to samples in the "Munsell Book of Color", Opposite Hue Edition and/or Neighboring Hue Edition, Munsell Color Co., Inc., Baltimore, Maryland (1950), which publication is incorporated herein by reference. This book uses numbered steps of lightness and of chroma to define the amount of lightness vs. darkness, and the color of an image. With L referring to 2 times the "value" in lightness, and C referring to the "chroma", as defined in the reference, the terms "dark", "blackish", and "black" as used in this application can be defined by use of the expression $$L+C$$

The value of L+C will be referred to as the darkness number for reflection. By "dark" it is meant that the darkness number for reflection is no greater than about 10. By "blackish" it is meant that the darkness number for reflection is no greater than about 8. By "black" it is meant that the darkness number for reflection is no greater than about 6.

With respect to transmitted light, the image is on a transparency (typically projected with enlargement onto a screen) and colors and luminance can be defined by the reference "Colorimetry; Official Recommendations of the International Commission on Illumination", Publication CIE No. 15 (E-1.3.1), Bureau Central De 2a Cie, Paris, France (1971), and by "CIE Recommendations on Uniform Color Spaces, Color-Difference Equations, and Metric Color Terms", Supplement No. 2 to CIE Publication No. 15 (E-1.3.1), op.cit. (May 1976), both references incorporated herein by reference. Specifically, "Recommendation 1" (CIELUV) of the Supplement is followed.

Employing source illuminant "B", representing direct sunlight with a correlated color temperature of approximately 4874 K, and a 4° angular viewing field, a darkness number for transmittance can be defined by the value $L^*+0.57C^*$, wherein $L^*$ is termed metric lightness and C is termed metric chroma, as defined by the reference cited immediately hereinabove.

By "dark" it is meant that the darkness number for transmittance is no greater than about 63. By "blackish" it is meant that the darkness number for transmittance is no greater than about 42. By "black" it is meant that the darkness number for transmittance is no greater than about 21.

Once thermographically imaged, the image density and the density of the nonimaged background areas can be measured using a densitometer. Exemplary is a MacBeth Model 504 densitometer, available from MacBeth Corp., Newburgh, New York. This instrument, when used with a Wratten No. 106 visual filter, can measure the density of a sample following approximately the human eye sensitivity. Alternatively, the density of the image can be measured using three colored filters, red, green and blue, which are standard Wratten filters, numbers 92, 93 and 94 respectively. The densitometer readings can be correlated to "dark", "blackish" and "black" as used in this application, and can be used to further define these terms.

By "dark" it is meant that the density using the visual filter is not less than about 0.7, and the density using the green filter is not less than about 0.7. When the density using the visual filter is between about 0.7 and 0.8, the densities using the red or blue filters preferably should not be less than about 0.65. Alternatively, when the density using the visual filter is greater than about 0.8, the density using the green filter should be greater than about 1.0, but the density using either the red or blue filters (but not both) may be as low as about 0.30, but no lower.

By "blackish" it is meant that the density using the visual filter is no less than about 1.0, and the density using any one colored filter, red, green or blue, is no less than about 0.9.

By "black" it is meant that the density using the visual filter is greater than about 1.3 and the densities using each of the colored filters are greater than about 1.0.

It is preferred that all of the leuco dyes in the formulation be capable of being rapidly oxidized in the system by nitrate ion. To evaluate whether a leuco dye will oxidize in the preferred time period, the following test may be followed: 0.05 grams of the leuco dye in 5 ml of tetrahydrofuran is added to a solution of 0.1 grams bromanil in 5 ml of tetrahydrofuran. This mixture should display its characteristic leuco dye color within about three minutes at room temperature, and preferably within about 1 minute.

It is additionally preferred that the leuco dyes of the present invention have sensitivities within a particular range. The sensitivities of the dyes are measured using the CATS, Cam Activated Thermo Sensitometry, test. The CATS test is performed according to the following procedure. A coating composition is prepared comprising:

- 0.045 gm leuco dye
- 0.050 gm phthalic acid
- 0.005 gm phenidone
- 1.50 gms cellulose acetate butyrate, available under the tradename "CAB 171-15S", from Eastman Organic Chemicals, dissolved in 8.5 gms of a 25:75 by weight solution of THF and acetone
- 0.050 gms aluminum nitrate nonahydrate.

This solution was coated on primed polyester film, 100 microns thick, at 75 microns wet thickness and dried at 43° C. in a forced air oven for 8 minutes. The film is 20.32 cm long and 5.08 cm wide. A white piece of paper, 20.32 cm long and 5.08 cm wide, printed with black lines running parallel to the width, which are 0.5 mm in width and 0.5 mm apart, is superimposed over the coated side of the film. This construction is placed lengthwise on a platen with the uncoated side of the film up. The platen is equipped with a source to heat the film to 40° C. and with a vacuum which pumps the air from between the film and the platen and holds the film and the paper flat on the platen. A 1350 watt infrared linear filament lamp equipped with an elliptical linear reflector is stationed at one end of the platen parallel to the width of the film and 2.54 cm from the surface of the platen. A cam drive then moves the platen carrying the film and paper at a linearly accelerating rate under the infrared lamp. The platen accelerates smoothly and the film exposure is logarithmic along the length of the film. Dwell time at the beginning of the exposure is less than 1.0 second and at the end of the 20.32 cm of film, the exposure is less than about 0.1 second.

The length of the film which visually images is a measure of the sensitivity of the dye. The part of the film which receives the least exposure, i.e., the least heat, does not image. Measurements are made along the strip of imaged film. A zero point is defined to be 15.24 cm from the end of the film which has the longest exposure time. At this zero point the film will transmit practically all incident light, i.e., there will be no visible image. The light transmission is measured at this point with a MacBeth densitometer using a visual filter. The point along the imaged film is found where the reading is 0.3 above that at the zero point. The distance between these readings is measured. A short distance, i.e., less than about 100 mm, results when the umimaged area is relatively small and indicates that the dye is relatively sensitive. A larger distance, i.e., greater than about 100 mm, results when there is a relatively long unimaged area and indicates that the dye has a relatively low sensitivity. Preferably the CATS sensitivity of the film is 130 mm or less. More preferably the CATS sensitivity is 100 mm or less, and most preferably 90 mm or less.

It is surprising to find that when the CATS sensitivity of the combined dye coatings of the present invention are determined, they are independent of the CATS sensitivity of any of the individual dyes used in the dye combination. The examples illustrate this point. Thus, the imaging compositions of the present invention, even though they are formed from dyes with varying sensitivities, i.e., differences in CATS sensitivities of about 7 mm, 15 mm and more, will combine to give a neutral dark or blackish to black image wherein all the dyes act as a single dye having a single sensitivity.

Preferred leuco dyes for use in the practice of the present invention include triphenylmethane dyes, triarylmethane dyes, styryl dyes, N-acyl oxazine dyes, N-acyl thiazine dyes, cyanine dyes, N-acyl diazine dyes and xanthene dyes.

A preferred two-dye combination comprises the triphenylmethane dye

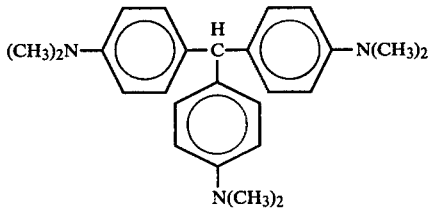

and the styryl dye,

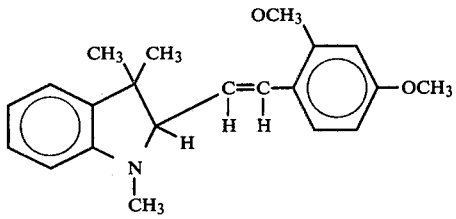

A particularly preferred two-dye combination comprises the styryl dye

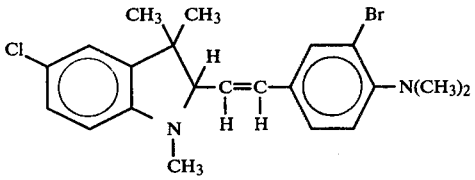

and the styryl dye

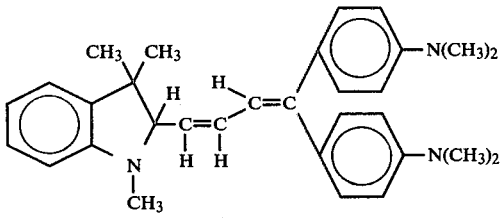

Three-dye combinations are preferred over two-dye combinations. A preferred three-dye combination which upon oxidation provides a neutral dark grey to black image comprises the triphenylmethane dye

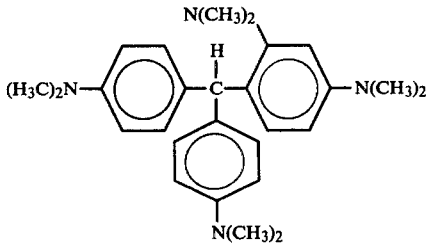

the triarylmethane dye

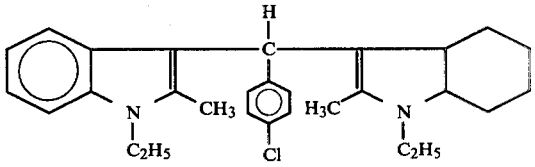

and the styryl dye

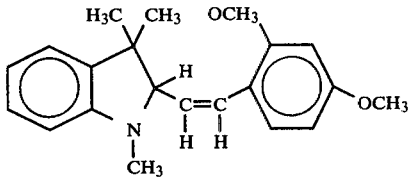

A particularly preferred three-dye combination comprises the oxazine dye

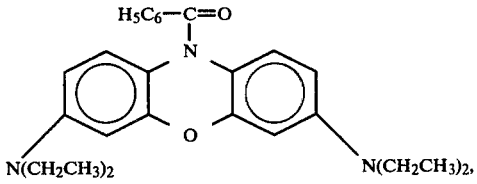

the styryl dye,

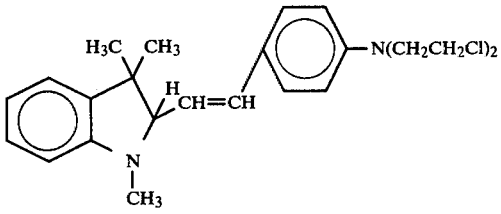

and the styryl dye,

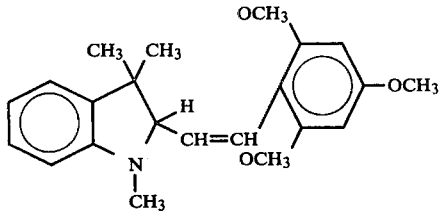

Another particularly preferred three-dye combination comprises the following three styryl dyes

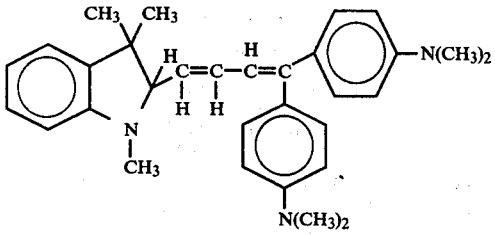

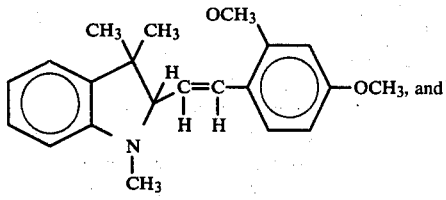

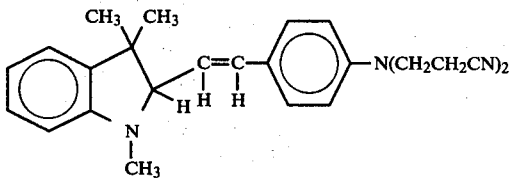

Four-dye combinations are particularly preferred; they are preferred even over three-dye combinations. A preferred four-dye combination comprises the triphenylmethane dye

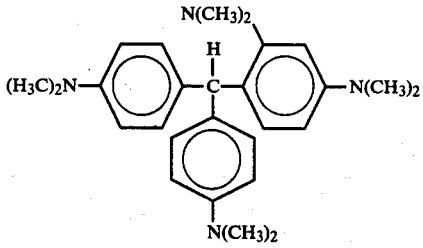

the triarylmethane dye

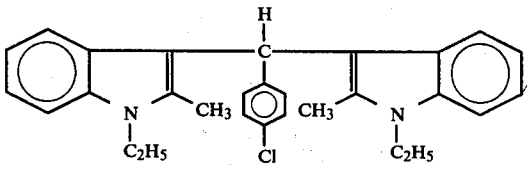

the styryl dye

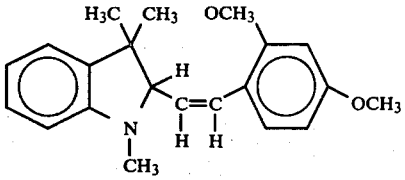

and the oxazine dye

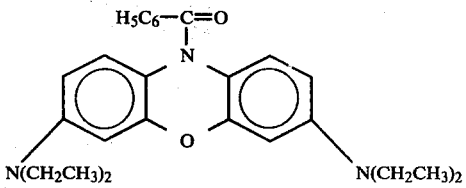

Another preferred four-dye combination comprises the combination immediately above, with the oxazine dye substituted by the thiazine dye,

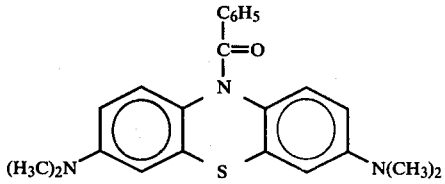

The leuco dyes should be present in an overall concentration of at least 0.3% by weight of the binder, preferably at least 1% by weight of the binder, and most preferably from 2 to 10% or more by weight of the binder. It is preferred to provide the various leuco dyes in proportions so that when combined they absorb light uniformly throughout the region between about 450 and 650 nm. This is simply accomplished by adjusting the concentration of each dye so that at $\lambda_{max}$ for each dye the percent transmission, or the absorbance value, for each dye is approximately equal.

Depending upon the relative ease of colorizing the particular dye selected, the relative proportion of nitrate ion to dye may vary. As a general rule, at least 0.1 mole of nitrate ion per mole of dye is desirable in the practice of the present invention. At least 1 mole of nitrate per mole of dye is more preferred, with about 2 to 3 moles of nitrate per mole of dye being most preferred. It is also preferred that there not be more than 8.0 mole of nitrate per mole of dye, in order to avoid bleaching of the imaged area.

It is necessary where the more sensitive leuco dyes such as styryl, cyanine, xanthene, and di-indolyl substituted triarylmethane dyes are utilized that a stabilizer be included in the formulation. Additionally, stabilizers may be used with the less sensitive leuco dyes to reduce the possibility of premature oxidation. Useful stabilizing agents are disclosed in commonly assigned U.S. Ser. No. 218,558 filed of even date herewith, incorporated herein by reference. These stabilizing agents are aromatic compounds having at least two substituents selected from the group consisting of amino and hydroxy substituents. The preferred aromatic groups are benzene and naphthalene rings. Of the hydroxy and amino substituents on the aromatic nucleus there must be at least two which are ortho or para where the aromatic nucleus is a benzene ring, and in equivalent positions where the aromatic is a polynuclear aromatic. This requirement enables the polyhydroxy aromatic compounds to form quinones upon oxidation, the polyamino aromatic compounds to form diimines upon oxidation, and the aromatic compounds having amino and hydroxy substituents to form quinonimines upon oxidation. In addition it is preferred that these two substituents be coplanar with the aromatic nucleus, i.e., neither substituent is adjacent to a bulky substituent such as tertiary pentyl or higher tertiary alkyl groups, which would force the functional substituent out of the plane of the aromatic nucleus. The aromatic nucleus may be further substituted by groups, such as alkoxy groups having about 1 to 3 carbon atoms, alkyl groups, branched or straight chain, having about 1 to 3 carbon atoms, alkyl substituted amino groups having about 1 to 4 carbon atoms, and ether groups having about 1 to 5 carbon atoms, so long as they do not render the stabilizing agent insoluble in the binder. It is preferred that the additional substituents not be strong electron withdrawing groups, such as acyl groups, sulfone groups, sulfonic acid groups, or a plurality of chlorine substituents. An exception to this preference is 4-amino-2,6-dibromophenol.

Useful stabilizing agents include catechol; hydroquinone; trimethylhydroquinone; 2-t-butylhydroquinone; 2,5-di-t-butylhydroquinone; 3,5-di-isopropylcatechol; 4-(2-aminoethyl)-2-hydroxy phenol.HCl; 1,2,3-trihydroxybenzene; 1,2,4-trihydroxybenzene; 2,3-dihydroxynaphthalene; 1,7-dihydroxynaphthalene, 2,6-dihydroxynaphthalene; o-aminophenol; p-aminophenol; 4-amino-1-naphthol.HCl; 2-amino-4-chlorophenol; 4-amino-3-methylphenol; 4-amino-2,6-dibromophenol; p-phenylenediamine; o-phenylenediamine; 2,3-diaminonaphthalene; and 2,4-diaminophenol.2HCl. Preferred stabilizing agents include catechol; hydroquinone; 2-t-butylhydroquinone; 2,5-di-t-butylhydroquinone; 3,5-di-isopropylcatechol; 4-(2-aminoethyl)-2-hydroxylphenol.HCl; 1,2,3-trihydroxybenzene; 1,2,4-trihydroxybenzene; o-aminophenol; p-aminophenol; 4-amino-3-methylphenol; 4-amino-2,6-dibromophenol; 2,3-diaminonaphthalene; and 1,7-dihydroxynaphthalene. Particularly preferred stabilizing agents include catechol; hydroquinone; 2-t-butylhydroquinone; 1,2,3-trihydroxybenzene; 1,2,4,-trihydroxybenzene; and p-aminophenol.

It is preferred to have between about 0.19 and 0.90 mole of stabilizer per mole of dye. It is more preferred to have between about 0.2 and 0.8 mole of stabilizer per mole of dye, and it is most preferred to have between about 0.3 and 0.6 mole of stabilizer per mole of dye.

The acids useful in the present invention are acids as generally known to the skilled chemist. Organic acids are preferred, but inorganic acids (generally in relatively smaller concentrations) are also useful. Organic acids having carboxylic groups are more preferred. Acids having a pKa of about 3 to 3.5 are preferred since stronger acids provide systems which are more active and may not remain latent. The acid may be present in a molar concentration of from 0 to 10 times that of the nitrate ion. More preferably it is present in a molar concentration of from 0.2 to 2.0 times that of the nitrate ion.

The imaging compositions of the present invention may contain various materials in combination with the essential ingredients. For example, lubricants, coating aids, antioxidants (e.g., ascorbic acid, hindered phenols, phenidone, etc. in amounts that would not prevent oxidation of the dyes when heated), surfactants, antistatic agents, mild oxidizing agents in addition to the nitrate, and brighteners may be used without adversely affecting the practice of the invention.

The imaging layers of the present invention must allow reactive association of the active ingredients in order to enable imaging. That is, the individual ingredients may not be separated by impenetrable barriers within the layer, as with dispersed immiscible phases. Generally, the active ingredients are homogeneously mixed (e.g., a molecular mixture of ingredients) within the layer. They may be individually maintained in heat softenable binders which are dispersed or mixed within the layer and which soften upon heating to allow migration of ingredients, but this would require a longer development time.

In forming the dye layer, or coating the dye layer onto a substrate, temperatures should, of course, not be used during manufacture which would completely colorize the layer. Some colorization may be tolerable, but this depends upon the particular end use of the product. It is preferred, however, that little or no dye be colorized during forming or coating so that a more standardized layer can be formed. Depending on the anticipated development temperature, the coating or forming temperature can be varied. Therefore, if the anticipated development temperature were, for example, 100° C. the drying temperature could be 65° C. or less provided the dwell time was greater than about one minute. A reasonable development temperature range is between 75° and 100° C. and a reasonable dwell time is between 0.15 and 0.5 seconds, preferably at between 80° C. and 90° C. for 0.2 to 0.3 seconds, with the longer times most likely associated with the lower development temperatures.

All of this will be more thoroughly understood by consideration of the following examples:

EXAMPLE 1

The following coating solution was prepared:

| | |
|---|---|
| Triphenylmethane dye (1) | .040 gm |
| Triarylmethane dye (2) | .011 gm |
| Styryl (3) | .011 gm |
| THF | 1.15 gm |
| Ethanol | 4.60 gm |
| Phenidone | .005 gm |
| Catechol | .006 gm |
| Phthalic Acid | .058 gm |
| Aluminum Nitrate Nonahydrate | .058 gm |
| Cellulose Acetate Butyrate, available under the trade name "CAB 171-15S" from Eastman Kodak | 11.5 gm (as a 15% by weight solution in acetone/methyl-isobutyl ketone, 85:15 percent by weight respectively) |

The structures of the dyes were as follows:

Triphenylmethane dye

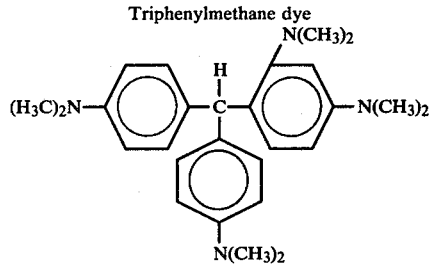

(1)

CATS Sensitivity 77mm

Triarylmethane dye

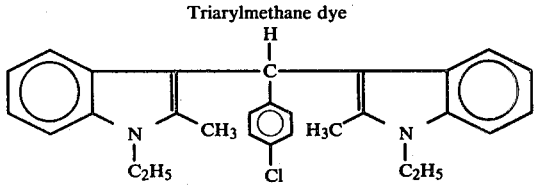

(2)

-continued

CATS Sensitivity-70

Styryl

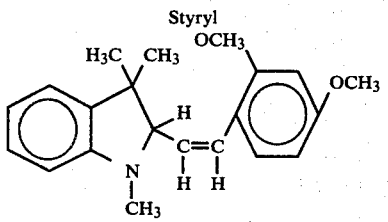

(3)

CATS Sensitivity-75mm

This solution was coated on primed polyester film, 100 microns thick, at 75 microns wet thickness. After drying at 43° C. (110° F.) in a forced air oven for 6 minutes the film was imaged on a Model 45 infrared transparency maker, available from 3M Co. The imaging speed, i.e., the rate at which the film passes under a 1350 watt infrared lamp in the transparency maker, was 5.6 cm/sec. The CATS sensitivity of the dried film was 110 mm. Thus, it is less sensitive than the individual dyes that were combined to make the black image. We measured the image density with standard filters on a MacBeth densitometer, and obtained the following results.

| | $D_{max}$ | $D_{min}$ |
|---|---|---|
| Visual filter | .71 | .04 |
| Red Filter | .53 | .03 |
| Green filter | .77 | .04 |
| Blue filter | .61 | .04 |

These densities appear to the eye to be a greyish black and the image on projection was dark.

The darkness number for reflection was determined by comparing the image against a white background to samples in the "Munsell Book of Color." The darkness number for reflection was determined to be about 8, indicating that the image was dark.

EXAMPLE 2

A coating solution was prepared according to Example 1, except that 0.01 gm of an oxazine dye was added. The oxazine dye had the following structure:

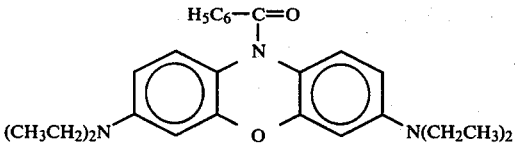

CATS-97mm

The composition was coated and dried, as in Example 1. The dried film had a sensitivity (CATS) of 115 mm. Thus, the sensitivity of the combined dye layer was less than the sensitivity of any of the individual dyes used in the combination. The film was imaged as in Example 1, and the MacBeth densitometer readings using standard densitometer filters were:

| | $D_{max}$ | $D_{min}$ |
|---|---|---|
| Visual filter | .85 | .03 |
| Red filter | .89 | .03 |
| Green filter | .88 | .03 |
| Blue filter | .85 | .04 |

The image was uniformly dark to the eye and the projected image on the screen was quite dark. This image was darker than the image of Example 1.

EXAMPLE 3

Example 1 was repeated except that 0.01 gm of the following thiazine dye was added:

Thiazine dye

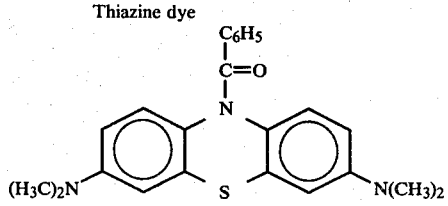

CATS-100mm

The CATS sensitivity of the coated and dried film was 115 mm. Thus, again, the sensitivity of the combined dye layer was less than the sensitivity of any of the individual dyes used in the combination. The MacBeth densitometer readings of the imaged film were:

| | $D_{max}$ | $D_{min}$ |
|---|---|---|
| Visual filter | .73 | .03 |
| Green filter | .76 | .03 |
| Red filter | .69 | .04 |
| Blue filter | .65 | .03 |

Addition of the thiazine dye increased the density of the red filter reading. The image was darker to the eye and less colored than the image of Example 1 and the projected image was dark on the screen and without preceptable color.

EXAMPLE 4

The following coating solution was prepared:

| | |
|---|---|
| Oxazine dye (1) | .059 gm |
| Styryl dye (2) | .030 gm |
| Styryl dye (3) | .018 gm |
| Phenidone | .005 gm |
| Catechol | .010 gm |
| Aluminum nitrate nonahydrate | .077 gm |
| Urea nitrate | .044 gm |
| THF | 4.0 gm |
| Cellulose acetate butyrate, as in Example 1 | 9.0 gm |

The structures of the dyes were as follows:

(1) The oxazine dye structure was the same as in Example 2.

The styryl dye was

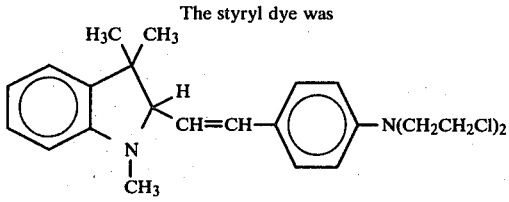

(2)

-continued

CATS Sensitivity-87mm

The styryl dye was (3)

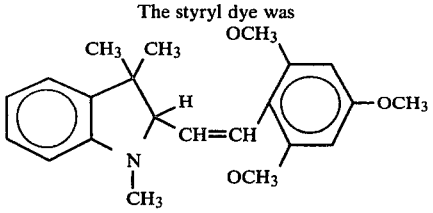

CATS Sensitivity-70mm

The composition was coated and dried as in Example 1. The CATS sensitivity of the film was 108 mm. Again, the sensitivity of the combined dye layer was less than the sensitivity of any individual dye used in the combination. The film was imaged as in Example 1 and the density readings on a MacBeth densitometer using standard filters were:

| | $D_{max}$ | $D_{min}$ |
|---|---|---|
| Visual filter | 1.40 | 0.04 |
| Red filter | 1.42 | .04 |
| Green filter | 1.23 | .03 |
| Blue filter | 1.04 | .04 |

The image was a bluish shaded black to the eye and the projected image was black.

EXAMPLE 5

A black imaging film was prepared by combining two leuco dyes. The formulation was:

| | |
|---|---|
| Phthalic acid | .05 gm |
| Aluminum nitrate nonahydrate | .05 gm |
| Triphenylmethane dye (1) | .06 gm |
| Styryl dye (2) | .06 gm |
| Phenyl substituted benzotriazole available under the trade name "Tinuvin P" from Ciba Geigy | .04 gm |
| Phenidone | .005 gm |
| Methanol | .5 gm |
| Ethanol | 4.5 gm |
| Cellulose acetate butyrate, as in Example 1 | 10.0 gm |

The structures of the dyes were (1)

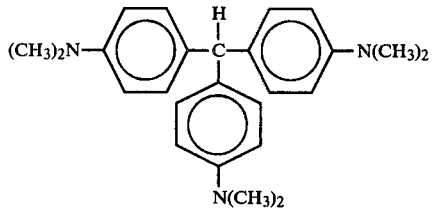

CATS sensitivity-120mm (2)

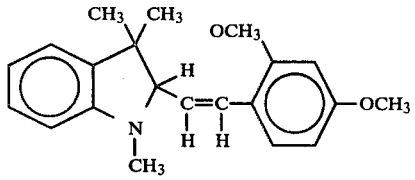

CATS sensitivity-75mm

The composition was coated and dried as in Example 1. The sensitivity of this film was 130 mm. The film was imaged and the image densities were:

| | $D_{max}$ | $D_{min}$ |
|---|---|---|
| Red filter | .30 | .03 |
| Green filter | 1.22 | .06 |
| Blue filter | 1.23 | .06 |
| Visual filter | .82 | .06 |

The image appears dark reddish. However, the projected image does appear dark and the reddish color is not significant.

EXAMPLE 6

Another two leuco dye imaging composition was prepared. The formulation was:

| | |
|---|---|
| Styryl dye (1) | 0.038 gm |
| Styryl Blue dye (2) | 0.050 gm |
| Phenidone | 0.507 gm (1% solution in ethanol) |
| Catechol | 0.118 gm (5% solution in THF) |
| Phthalic Acid | 0.060 gm |
| Tetrahydrofuran | 2.00 gm |
| Ethanol | 2.00 gm |
| Aluminum Nitrate Nonahydrate | 0.051 gm |
| Cellulose acetate butyrate, available under the trade name "CAB-171 15S" from Eastman Kodak (15% solution in acetone/THF, 75/25) | 9.048 gm |

The structure of the dyes were:

(1)

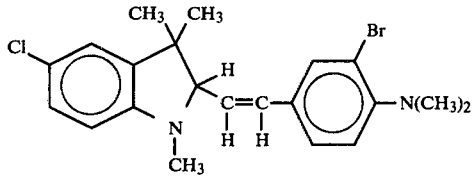

CATS sensitivity-95mm (2)

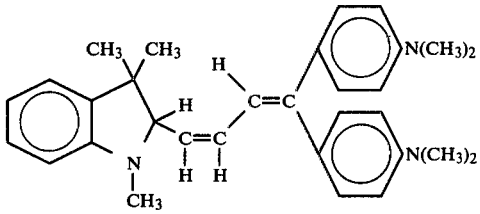

CATS sensitivity-85mm

The composition was coated and dried as in Example 1. The CATS sensitivity of the dried film was 130 mm. Thus, the sensitivity of the two dye combination (130 mm) was less than the sensitivity of the two individual dyes in the combination (95 mm and 85 mm).

The dried coated film was imaged as in Example 1. The image densitities were measured with standard filters on a MacBeth densitometer. The results are reported below:

| | $D_{max}$ | $D_{min}$ |
|---|---|---|
| Visual filter | 1.23 | 0.03 |
| Red filter | 1.24 | 0.03 |

-continued

| | $D_{max}$ | $D_{min}$ |
|---|---|---|
| Green filter | 1.36 | 0.03 |
| Blue filter | 0.92 | 0.03 |

The image appeared bluish black to the eye. The projected image was a dense black.

EXAMPLE 7

The following example illustrates that the combined dye compositions of the present invention produce imaging films with properties which are unexpected and not predictable merely from an examination of he imaging properties of the individual dyes.

The following coating compositions were prepared, compositions 1–3 contained only one individual dye while composition 4 contained a combination of all three dyes, according to the present invention.

| | |
|---|---|
| Composition 1 | |
| Styryl Dye (1) | 0.030 gm |
| Phthalic Acid | 0.018 gm |
| Phenidone | 0.206 gm (as a 1% solution in EtOH) |
| Catechol | 0.047 gm (as a 5% solution in THF) |
| Tetrahydrofuran | 2.000 gm |
| Ethanol | 2.000 gm |
| $Al(NO_3)_3$ nonahydrate | 0.018 gm |
| Cellulose acetate butyrate, as in Example 1 | 10.207 gm |
| Composition 2 | |
| Styryl Dye (2) | 0.024 gm |
| Phthalic Acid | 0.016 gm |
| Phenidone (1% solution in EtOH) | 0.210 gm |
| Catechol (5% solution in THF) | 0.056 gm |
| Tetrahydrofuran | 2.090 gm |
| Ethanol | 2.022 gm |
| $Al(NO_3)_3$ nonahydrate | 0.018 gm |
| Cellulose acetate butyrate, as in Example 1 | 10.268 gm |
| Composition 3 | |
| Oxazine Dye (3) | 0.043 gm |
| Phthalic Acid | 0.022 gm |
| Phenidone (1% solution in EtOH) | 0.209 gm |
| Catechol (5% solution in THF) | 0.048 gm |
| Tetrahydrofuran | 2.010 gm |
| Ethanol | 2.027 gm |
| $Al(NO_3)_3$ nonahydrate | 0.030 gm |
| Cellulose acetate butyrate, as in Example 1 | 10.172 gm |
| Composition 4 | |
| Styryl Dye (1) | 0.030 gm |
| Styryl Dye (2) | 0.020 gm |
| Oxazine Dye (3) | 0.040 gm |
| Phenidone (1% solution in EtOH) | 0.500 gm |
| Catechol (5% solution in THF) | 0.120 gm |
| Phthalic Acid | 0.050 gm |
| Tetrahydrofuran | 2.000 gm |
| Ethanol | 2.000 gm |
| $Al(NO_3)_3$ nonahydrate | 0.051 gm |
| Cellulose acetate butyrate, as in Example 1 | 10.120 gm |

Note that the concentration of each dye in the combined dye composition is approximately equal to its concentration in the individual dye compositions and that the nitrate ion concentration in the combined dye composition is approximately equal to the sum of the nitrate ion concentrations in the individual dye compositions. The compositions were coated and dried as in Example 1. The coated films were imaged as in Example 1 and the image densities were measured. Imaged films made from compositions 1, 2 and 3 were superimposed. The density readings for this construction are also included.

| | Dye Film (1) | | Dye Film (2) | | Dye Film (3) | | Combined Dye Film (4) | | Superimposed Dye Films (1), (2) and (3) | |
|---|---|---|---|---|---|---|---|---|---|---|
| Filter | $D_{max}$ | $D_{min}$ | $D_{max}$ | $D_{min}$ | $D_{max}$ | $D_{min}$ | $D_{max}$ | $D_{min}$ | $D_{max}$ | $D_{min}$ |
| Visual | 0.14 | 0.02 | 0.02 | 0.02 | 0.72 | 0.02 | 1.39 | 0.02 | 1.13 | 0.07 |
| Red | 0.03 | 0.02 | 0.03 | 0.02 | 1.16 | 0.02 | 1.49 | 0.03 | 1.23 | 0.08 |
| Green | 0.62 | 0.03 | 0.14 | 0.02 | 0.27 | 0.03 | 1.52 | 0.03 | 1.05 | 0.11 |
| Blue | 0.31 | 0.04 | 0.42 | 0.04 | 0.11 | 0.04 | 1.21 | 0.04 | 0.79 | 0.13 |

The image densities ($D_{max}$) for the combined dye film (4) are greater than the sum of the image densities of the individual dye film (1), (2) and (3), and greater than the image densities for the superimposed films. The backgrounding ($D_{min}$) is less for the combined dye film than for the sum of $D_{min}$ for the individual dye films, and less than $D_{min}$ for the superimposed films. Thus one cannot predict the quality of images produced in the dye compositions of the present invention from an evaluation of the image produced by using the individual leuco dyes.

The image on the combined dye film appeared black to the eye and the image on projection was black.

As previously noted the combination of dyes used in the structures of the present invention surprisingly act as if they were a single dye with a specified sensitivity. This was observed in all of the above examples by the generation of an image which grew from initially a low optical density to the final optical density without a significant change in the hue and chroma of the image. This indicates that rather than the higher sensitivity leuco dyes imaging first and the other leuco dyes imaging upon heating, all of the leuco dyes were being oxidized to a colored form in a constant ratio to one another.

A significant change in hue is about 1 Munsell hue designation. Within a single hue this would be less than about 10 Munsell hue units. For example, in going from 7.5 PB to 7.5 P would be a change of 1 Munsell hue designation. The above designations (i.e. 7.5 PB and 7.5 P) are Munsell notations as known in the art.

What is claimed is:

1. An article with a single imageable layer carried on a substrate, said layer comprising a polymeric binder, a combination of at least two leuco dyes, an acidic material, and nitrate salt, said leuco dyes being colorless compounds which when subjected to an oxidation reaction form colored products, said acidic material being present in said layer in a molar concentration of at least 0.2 times that of the nitrate ion in said nitrate salt, said nitrate salt having a cation which is nonreactive with said leuco dyes and said nitrate salt capable of liberating an oxidizing amount of $HNO_3$ or oxides of nitrogen when heated to a temperature of no more than 200° C. for 60 seconds, said layer being capable of providing an at least dark, stable image upon imagewise oxidation.

2. The article of claim 1 wherein the darkness number of reflection for said image is no greater than about 10.

3. The article of claim 1 wherein the darkness number for transmittance for said image is no greater than about 63.

4. The article of claim 1 wherein said layer images at a temperature of between about 80° and 160° C. during a time range of between about 1 millisecond and 0.5 second.

5. The article of claim 1 wherein said layer upon imagewise oxidation provides an image which absorbs strongly throughout the region between about 450 and 650 nanometers.

6. The article of claim 1 wherein each of said leuco dyes has a CATS sensitivity of 130 mm or less upon imagewise oxidation.

7. The article of claim 1 wherein said leuco dyes are selected from the group consisting of triphenylmethane dyes, triarylmethane dyes, N-acyl thiazine dyes, N-acyl diazine dyes, and N-acyl oxazine dyes.

8. The article of claim 1 wherein at least one of said leuco dyes is selected from the group consisting of styryl dyes, cyanine dyes, and xanthene dyes and wherein said layer additionally comprises a stabilizer, said stabilizer being an aromatic compound having at least two substituents selected from the group consisting of amino and hydroxy substituents, wherein said polyhydroxy aromatic compounds form quinones upon oxidation, said polyamino aromatic compounds form diimines upon oxidation and said aromatic compounds having amino and hydroxy substituents form quinonimines upon oxidation.

9. The article of claim 8 wherein said stabilizing agent is selected from the group consisting of catechol; hydroquinone; 2-t-butylhydroquinone; 1,2,3-trihydroxybenzene; 1,2,4-trihydroxybenzene; o-aminophenol; p-aminophenol; 1,7-dihydroxynaphthalene; trimethylhydroquinone; 2,5-di-t-butylhydroquinone; 3,5-diisopropylcatechol; 4-(2-aminoethyl)-2-hydroxylphenol.HCl; 2,3-dihydroxynaphthalene; 2,6-dihydroxynaphthalene; 4-amino-1-naphthol.HCl; 2-amino-4-chlorophenol; 4-amino-3-methylphenol; 4-amino-2,6-dibromophenol; p-phenylenediamine; o-phenylenediamine; 2,3-diaminonaphthalene; and 2,4-diaminophenol.2HCl.

10. The article of claim 9 wherein said stabilizing agent is present in a concentration of about 0.19 to 0.90 mmoles per mmole of said leuco dye.

11. The article of claim 1 wherein said combination of leuco dyes is present as at least 0.3 percent by weight of said binder, and the nitrate ion is present in a ratio to said combination of leuco dyes, of at least 0.1 mole nitrate ion per mole leuco dye.

12. The article of claim 1 wherein said nitrate salt is present as a metal nitrate salt.

13. The article of claim 1 wherein said nitrate salt is present as a hydrated metal nitrate salt.

14. The article of claim 13 wherein said hydrated metal salt is selected from the class consisting of hydrated salts of zinc, cadmium, calcium, zirconyl, nickel, aluminum, chromium, iron (III), copper (II), magnesium, lead, cobalt, beryllium, cerous, lanthanum, manganous, mercurous, uranyl and thorium.

15. The article of claim 1 wherein said layer also contains an antioxidant.

16. The article of claim 1 wherein said layer also contains a stabilizing agent, said stabilizing agent being an aromatic compound having at least two substituents selected from the group consisting of amino and hydroxy substituents, wherein said polyhydroxy aromatic compounds form quinones upon oxidation, said polyamino aromatic compounds form diimines upon oxidation, and said aromatic compounds having amino and hydroxy substituents form quinonimines upon oxidation.

17. The article of claim 16 wherein said stabilizing agent is selected from the group consisting of catechol; hydroquinone; 2-t-butylhydroquinone; 1,2,3-trihydroxybenzene; 1,2,4-trihydroxybenzene; o-aminophenol; p-aminophenol; 1,7-dihydroxynaphthalene; trimethylhydroquinone; 2,5-di-t-butylhydroquinone; 3,5-diisopropylcatechol; 4-(2-aminoethyl)-2-hydroxylphenol.HCl; 2,3-dihydroxynaphthalene; 2,6-dihydroxynaphthalene; 4-amino-1-naphthol.HCl; 2-amino-4-chlorophenol; 4-amino-3-methylphenol; 4-amino-2,6-dibromophenol; p-phenylenediamine; o-phenylenediamine; 2,3-diaminonaphthalene; and 2,4-diaminophenol.2HCl.

18. The article of claim 17 wherein said stabilizing agent is present in a concentration of about 0.19 to 0.90 mmoles per mmole of said leuco dye.

19. A process for imaging the article of claim 1 comprising the steps of exposing said imageable layer to radiation in an imagewise fashion, and heating said imageable layer to oxidize all of said leuco dyes to a colored form in a constant ratio to one another.

* * * * *